US012434932B2

(12) United States Patent
Hupe

(10) Patent No.: US 12,434,932 B2
(45) Date of Patent: Oct. 7, 2025

(54) METHOD FOR ALIGNING A SHEET IN A FEEDER OF A SHEET-PROCESSING MACHINE

(71) Applicant: Heidelberger Druckmaschinen AG, Heidelberg (DE)

(72) Inventor: Robert Hupe, Neckargemünd (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 18/986,841

(22) Filed: Dec. 19, 2024

(65) Prior Publication Data

US 2025/0197145 A1 Jun. 19, 2025

(30) Foreign Application Priority Data

Dec. 19, 2023 (DE) ..... 10 2023 135 694.1

(51) Int. Cl.
*B65H 9/00* (2006.01)

(52) U.S. Cl.
CPC ..... *B65H 9/002* (2013.01); *B65H 2404/1424* (2013.01); *B65H 2601/272* (2013.01)

(58) Field of Classification Search
CPC ..... B65H 9/106; B65H 9/002
See application file for complete search history.

(56) References Cited

U.S. PATENT DOCUMENTS

| | | | | |
|---|---|---|---|---|
| 5,195,736 | A * | 3/1993 | Ishidate | B65H 3/5261 271/22 |
| 5,322,273 | A * | 6/1994 | Rapkin | B65H 9/002 271/227 |
| 7,959,150 | B2 * | 6/2011 | Krucinski | B65H 7/10 271/228 |
| 9,856,101 | B2 * | 1/2018 | Mizuno | B65H 9/006 |
| 2008/0061499 | A1 * | 3/2008 | DeGruchy | B65H 9/006 271/273 |

FOREIGN PATENT DOCUMENTS

| | | | | |
|---|---|---|---|---|
| DE | 102008038771 | A1 | 2/2010 | |
| EP | 1110888 | A1 | 6/2001 | |
| JP | 3186618 | B2 * | 7/2001 | B65H 7/10 |
| JP | 6087867 | B2 | 3/2017 | |

* cited by examiner

*Primary Examiner* — Howard J Sanders
(74) *Attorney, Agent, or Firm* — Laurence A. Greenberg; Werner H. Stemer; Ralph E. Locher

(57) ABSTRACT

A method for aligning a sheet in a feeder of a sheet-processing machine, where the sheet that is clamped between feed rollers and counterpressure rollers is delivered to a sheet transport device is aligned laterally during this process. First, the sheet is laterally aligned by clamping between feed and counterpressure roller pairs, and a slide to which the feed rollers are mounted, is moved with the clamped sheet transversely to the transport direction in a first direction. Second, the counterpressure rollers are raised from the sheet after the sheet has been gripped by the sheet transport device and before the slide with the feed rollers is moved back to its original position. The return movement of the slide takes place while the sheet, which is no longer clamped, is still present in the region between the feed and counterpressure roller pairs.

3 Claims, 11 Drawing Sheets

METHOD FOR ALIGNING A SHEET IN A FEEDER OF A SHEET-PROCESSING MACHINE

CROSS-REFERENCE TO RELATED APPLICATION

This application claims the priority, under 35 U.S.C. § 119, of German Patent Application DE 10 2023 135 694.1, filed Dec. 19, 2023; the prior application is herewith incorporated by reference in its entirety.

FIELD AND BACKGROUND OF THE INVENTION

The present invention relates to a method for aligning a sheet in a feeder of a sheet-processing machine, wherein the sheet is delivered to a sheet transport device in a transport direction by a first feed roller and a first counterpressure roller cooperating with the first feed roller, and by a second feed roller and a second counterpressure roller cooperating with the second feed roller, and is aligned laterally during this process.

A method of this kind is described in European published patent application EP 1 110 888 A1.

In the prior art method, large spacings are required between the successive sheets, and this reduces productivity.

SUMMARY OF THE INVENTION

It is accordingly an object of the invention to provide a method for aligning sheets in a sheet feeder which overcomes the above-mentioned and other disadvantages of the heretofore-known devices and methods of this general type and which provides for a method for aligning a sheet in a feeder of a sheet-processing machine, by which method the productivity of the machine is boosted.

With the above and other objects in view there is provided, in accordance with the invention, a method for aligning a sheet in a feeder of a sheet-processing machine, the method comprising:

delivering the sheet to a sheet transport device in a transport direction by a first feed roller and a first counterpressure roller cooperating with the first feed roller, and by a second feed roller and a second counterpressure roller cooperating with the second feed roller;

in a first alignment step, aligning the sheet laterally by clamping the sheet between the first feed roller and the first counterpressure roller and between the second feed roller and the second counterpressure roller, and moving a slide on which the first feed roller and the second feed roller are mounted together with the clamped sheet in a first direction transversely to the transport direction;

in a second alignment step, after the sheet has been gripped by the sheet transport device, lifting the first counterpressure roller from the sheet on the first feed roller, and lifting the second counterpressure roller from the sheet on the second feed roller; and in a third alignment step, subsequent to lifting the first and second counterpressure rollers from the sheet, moving the slide with the first feed roller and the second feed roller back in a second direction counter to the first direction while the sheet, which is no longer clamped between the first and second feed rollers and the respective first and second counterpressure rollers, is still present in a region between the first feed roller and the first counterpressure roller and in a region between the second feed roller and the second counterpressure roller.

In other words, the objects are achieved in accordance with the invention by a method for aligning a sheet in a feeder of a sheet-processing machine, wherein the sheet is delivered to a sheet transport device in a transport direction by a first feed roller and a first counterpressure roller cooperating with the first feed roller, and by a second feed roller and a second counterpressure roller cooperating with the second feed roller, and is aligned laterally during the process.

First, the sheet is laterally aligned in that the sheet is clamped between the first feed roller and the first counterpressure roller and between the second feed roller and the second counterpressure roller, and a slide, in which the first feed roller and the second feed roller are mounted, is moved with the clamped sheet transversely to the transport direction in a first direction.

Second, the first counterpressure roller is raised from the sheet on the first feed roller, and the second counterpressure roller is raised from the same sheet on the second feed roller after the sheet has been gripped by the sheet transport device and before the slide with the first feed roller and the second feed roller is moved back in a second direction, which is counter to the first direction.

Third, the return movement of the slide in the second direction takes place while the no-longer-clamped sheet is still in the region between the first feed roller and the first counterpressure roller and in the region between the second feed roller and the second counterpressure roller.

When the novel method according to the invention is employed, it is possible to reduce the spacings between the successive sheets. This increases the productivity of the machine.

Other features which are considered as characteristic for the invention are set forth in the appended claims.

Although the invention is illustrated and described herein as embodied in a method for aligning a sheet in a feeder of a sheet-processing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1A:
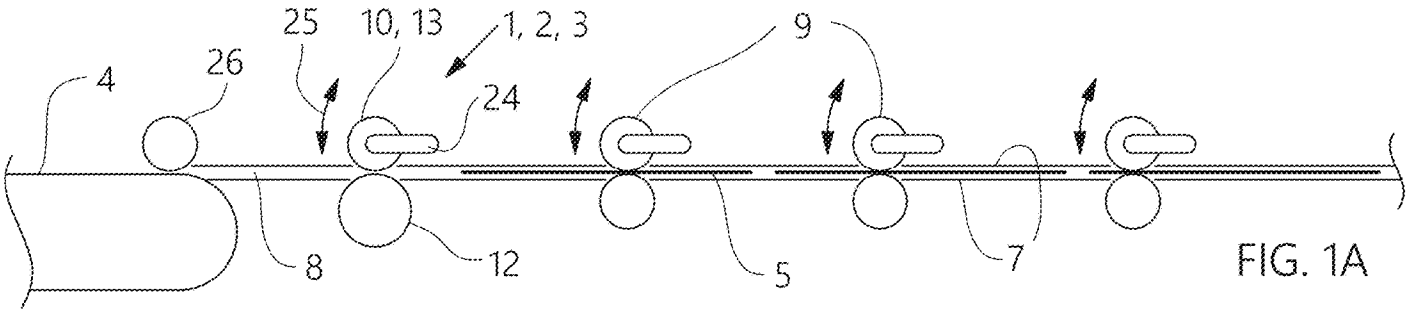
FIG. 1A is a diagrammatic side view of a sheet feeder in a given operating phase.
Figure 1B:
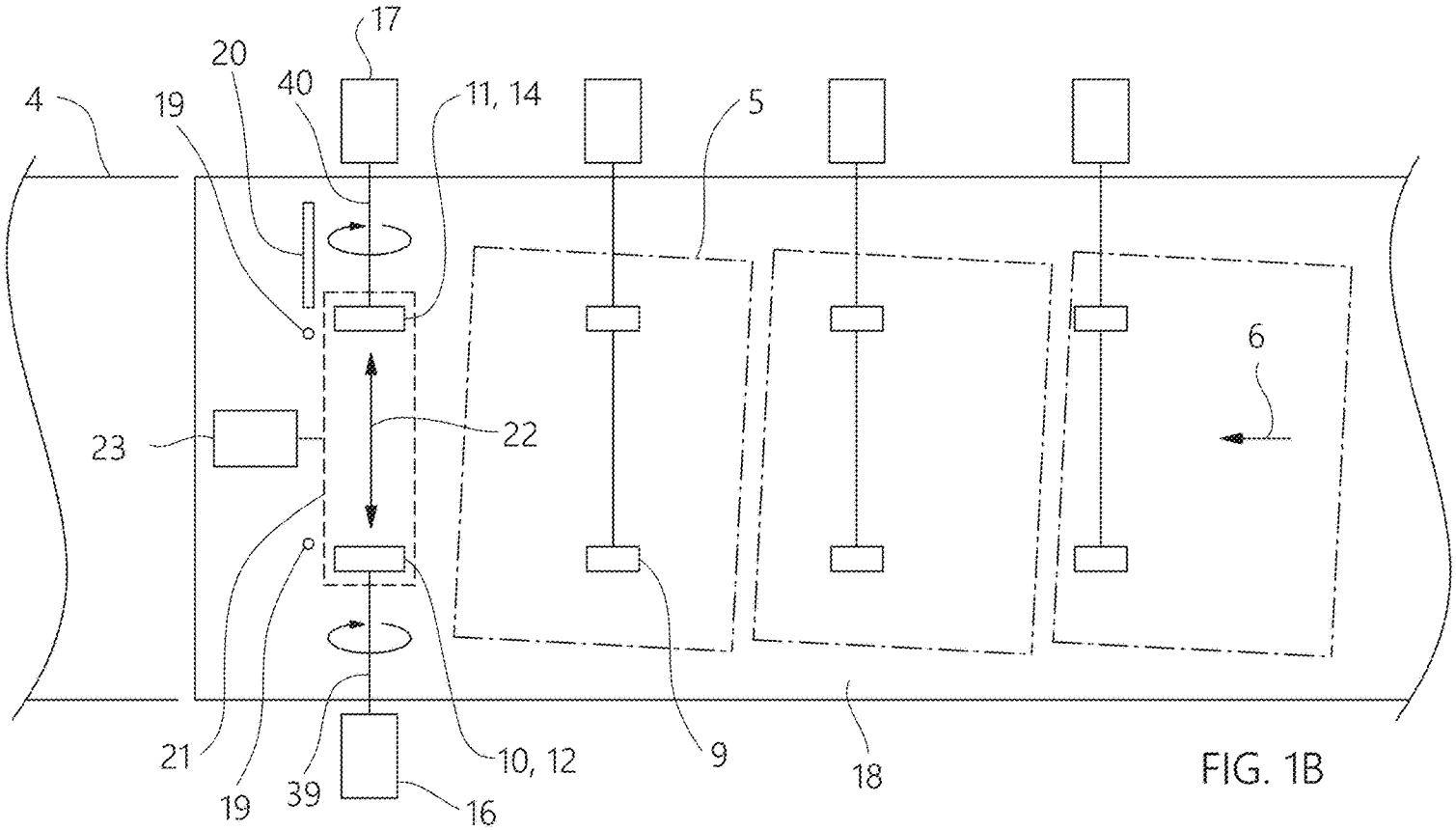
FIG. 1B is a plan view onto the sheet feeder in the given operating phase shown in FIG. 1A.

Referring now to the figures of the drawing in detail and first, in particular, to FIGS. 1A and 1B thereof, there is shown an alignment device 1 in a side view (FIG. 1A) and in a plan view (FIG. 1B). The alignment device 1 belongs to a feeder 2 of a sheet-processing machine 3. The machine 3 is a digital printing machine comprising a printing station, referred to as an imaging section 4. The feeder 2 transports sheets 5 to be printed in the imaging section 4 to the imaging section 4 in transport direction 6. During this process, the sheets 5 run between mutually parallel guide plates 7 in a transport gap 8 jointly formed by the guide plates 7. The sheets 5 are moved in the transport direction 6 by a series of transport devices 9. Each transport device 9 consists of two roller pairs, which are arranged offset with respect to one another transversely to the transport direction 6. The roller pairs make contact with the sheet 5 during transport, for which purpose apertures are formed in the guide plates 7, through which the roller pairs engage.

The alignment device 1 comprises a first roller pair 10 and a second roller pair 11. The first roller pair 10 consists of a first feed roller 12 and a first counterpressure roller 13, and the second roller pair 11 consists of a second feed roller 14 and a second counterpressure roller 15. In FIG. 1B, for reasons of greater clarity, the upper counterpressure rollers of the transport devices 9 and also the first counterpressure roller 13 and the second counterpressure roller 15 of the alignment device 1 are not included in the illustration; the first counterpressure roller 13 and the second counterpressure roller 15 can be seen in FIG. 7.

The bottom-mounted feed rollers of the transport devices 9 and also the feed rollers 12, 14 of the alignment device 1 are driven by electric motors. The two feed rollers of the respective transport device 9 are driven by a common motor. In contrast, the first feed roller 12 of the alignment device 1 is driven in rotation by a first motor 16, and the second feed roller 14 is driven in rotation by a second motor 17. With mutually synchronized rotation, the first feed roller 12 and the second feed roller 14 bring about a feed motion of the sheet 5 in the transport direction 6 without rotating the sheet 5 in the sheet transport plane 18 during this process. The sheet transport plane 18 is determined by the guide plates 7.

If the sheet 5 is askew relative to the transport direction 6, rotation of the sheet 5 about the vertical axis perpendicular to the transport plane 18, skew correction of the sheet 5, is necessary. To bring about this rotation, the first feed roller 12 and the second feed roller 14 are rotated asynchronously with respect to one another, e.g., the first feed roller 12 being rotated more slowly than the second feed roller 14 or vice versa, depending on the required direction of rotation of the sheet 5. To enable the first feed roller 12 and the second feed roller 14 to be selectively rotated synchronously or asynchronously, the first motor 16 and the second motor 17 are controlled in a coordinated manner by a controller.

The controller, which is not included in the drawing, receives information on the position of the sheet 5 as signals from a pair of optical sensors 19 or from a line sensor 20 and, on the basis of these signals, controls the two motors 16, 17. If, in a print job, the sheets 5 are transported in landscape mode with their long sheet edges in the lead, as illustrated in FIG. 1B, the signals of sensors 19 are used. Sensors 19 are reflection sensors. If, in a different print job, the sheets 5 are transported in portrait mode with their short sheet edges in the lead, the signals of the line sensor 20 are used. This ensures that, in both modes, the sheet 5 is aligned along its long sheet edge, something that is important for the further processing of the sheets 5.

The first feed roller 12 and the second feed roller 14 are rotatably mounted in a slide 21 in such a way as to be aligned coaxially with one another. The slide 21 is mounted in such a way that it can be adjusted together with the two feed rollers 12, 14 in, and counter to, a direction which is transverse to the transport direction 6. In FIG. 1B, the adjusting motion 22 of the slide 21 is indicated by a double arrow and is used for the lateral alignment of the sheet 5. A drive 23, which drives the adjusting motion 22 of the slide 21, is indicated symbolically in the highly schematized FIG. 1B and will be explained below in greater detail with reference to FIG. 6.

The first counterpressure roller 13 and the second counterpressure roller 15 are rotatably mounted in a support 24 and can be fed in to the first and second feed rollers 12, 14 and moved away from them again by means of a reciprocating motion 25 of the support 24. As will be explained in greater detail below with reference to FIG. 7, the support 24 is rotatably mounted, and therefore the reciprocating motion 25 is a pivoting motion. The periodic reciprocating motion 25 that takes place during the transport cycle of the sheets 5 is driven by a non-illustrated drive. The drive may be a pneumatic working cylinder, a linear drive, a lifting magnet, or a motorized cam mechanism. The alignment device 1 is followed in the transport direction 6 by a sheet transport device 26, which is a component part of the imaging section 4. The sheet transport device 26 comprises one or more transport rollers, which interact with a conveyor belt or a tray chain of the imaging section 4. The conveyor belt or the tray chain carries the sheets 5 during printing, carried out by means of an inkjet for example, and runs on a ring-shaped or endless path.

The operation of the alignment device 1 is explained below with reference to FIGS. 1A/1B to 6A/6B. The alignment device 1 is illustrated in a side view and a plan view in each operating phase—as in FIGS. 1A and 1B.

In the operating phase illustrated in FIGS. 1A and 1B, the first of the sheets 5 transported successively in the transport direction 6 has not yet reached the alignment device 1. The sheets 5 are illustrated by dash-dot phantom lines in FIG. 1B. The sheets 5 are transported through the transport device 9 with a small spacing between them.

Figure 2A:
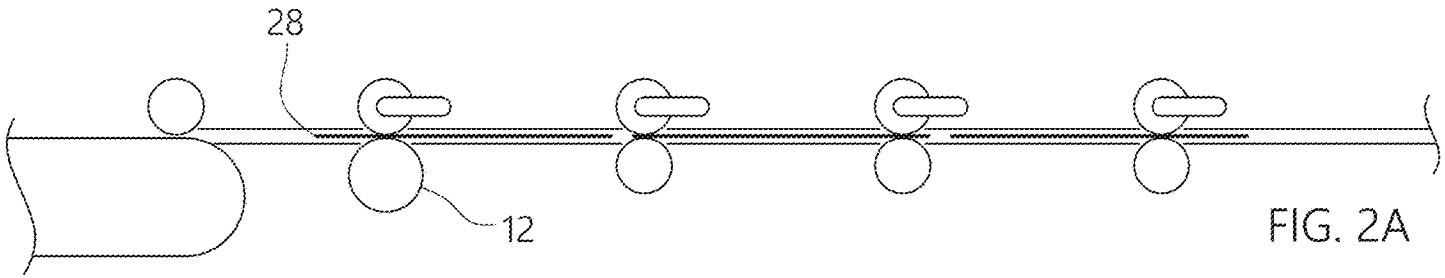
FIG. 2A is a diagrammatic side view of a sheet feeder in another operating phase.
Figure 2B:
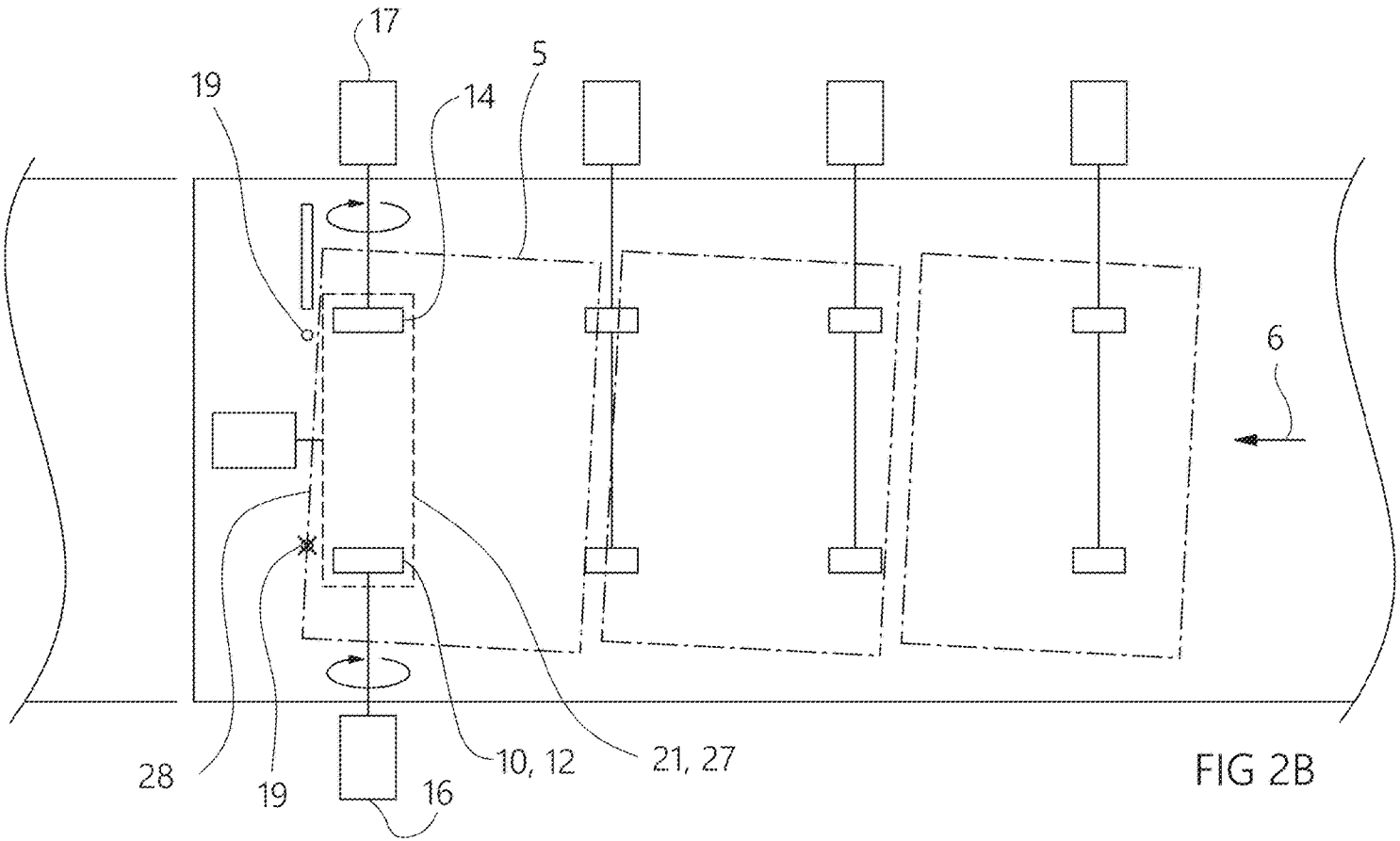
FIG. 2B is a plan view onto the sheet feeder in the operating phase shown in FIG. 2A.

In the operating phase according to FIGS. 2A and 2B, the front edge 28 of the first sheet 5 has already reached the alignment device 1. The sheet 5 is clamped between the feed rollers 12, 14 and the counterpressure rollers 13, 15 of the alignment device 1. The slide 21 is in a central neutral position 27 with respect to its adjusting motion 22. The motors 16, 17 are being controlled in such a way that the first feed roller 12 rotates at the same speed as the second feed roller 14. The front edge 28 of the sheet 5 has reached the sensor 19 that is on the left in the transport direction 6 or its target area and has triggered this sensor 19, this being indicated in the drawing by a cross. At this point in time, the front edge 28 has not yet reached the sensor 19 that is on the right in the transport direction 6.

Figure 3A:
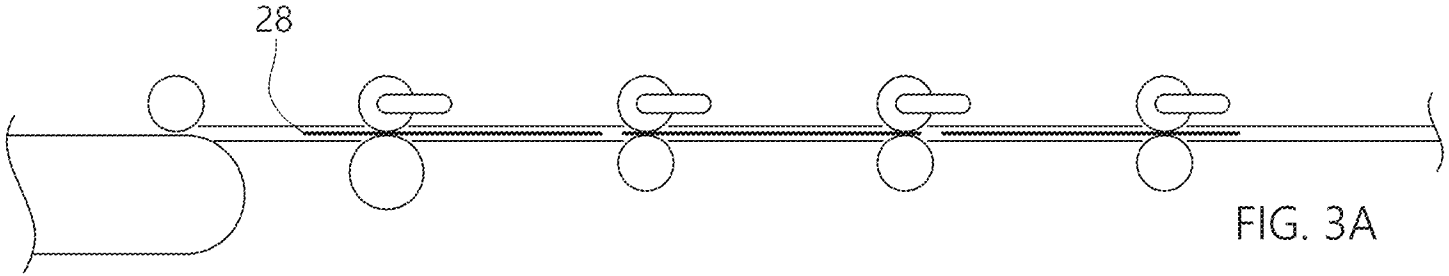
FIG. 3A is a diagrammatic side view of a sheet feeder in another operating phase.
Figure 3B:
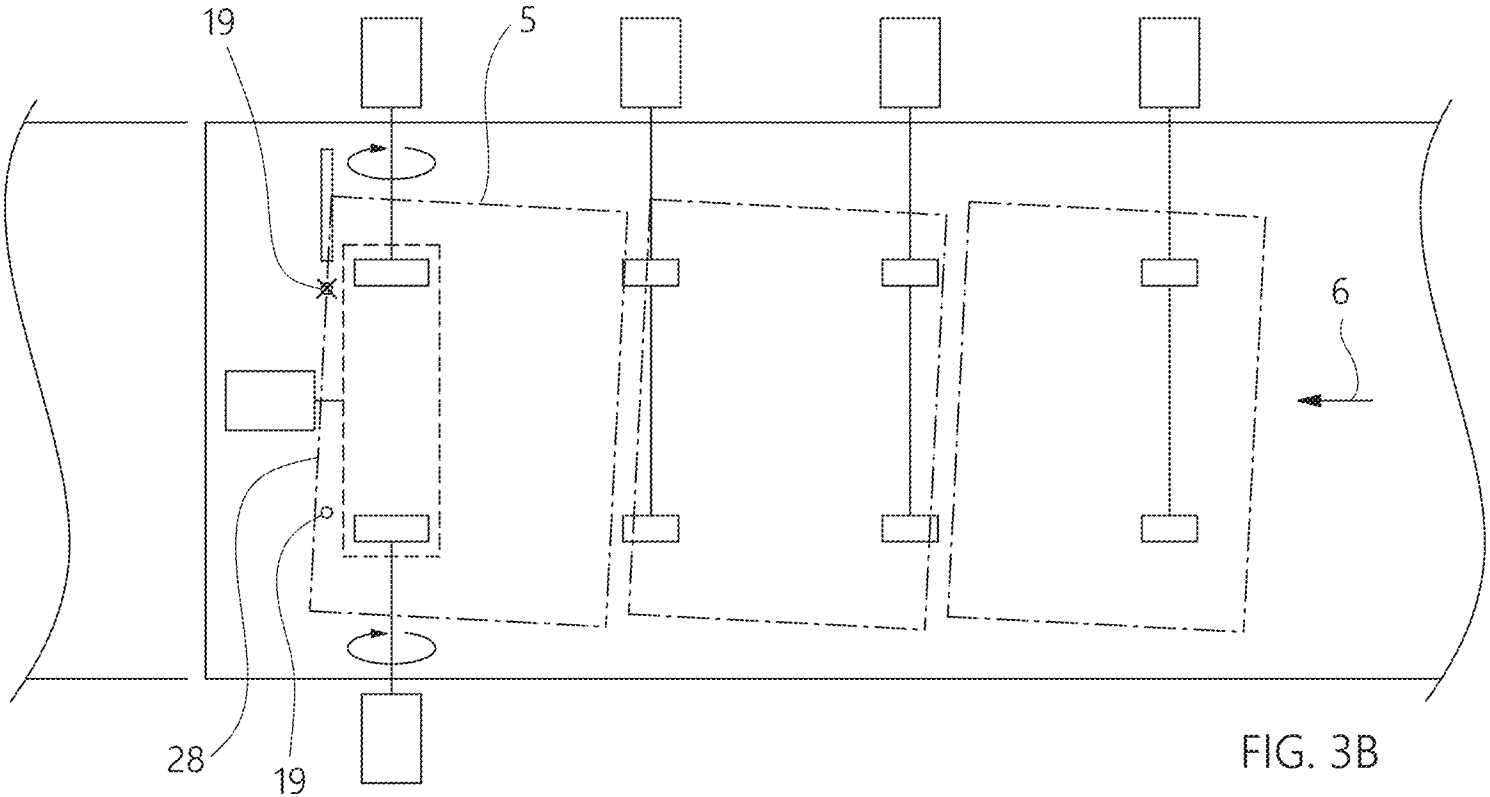
FIG. 3B is a plan view onto the sheet feeder in the operating phase shown in FIG. 3A.

In the subsequent operating phase according to FIGS. 3A and 3B, the front edge 28 has reached and triggered the sensor 19 that is on the right in the transport direction 6. The two sensors 19 are on an imaginary line that is orthogonal to the transport direction 6. From the time difference between the triggering of the left-hand sensor 19 (FIG. 2B) and the triggering of the right-hand sensor 19, the controller connected to the sensors 19 can calculate the skewing of the sheet 5, taking into account the known spacing between the sensors 19 (and the transport speed of the sheet).

Figure 4A:
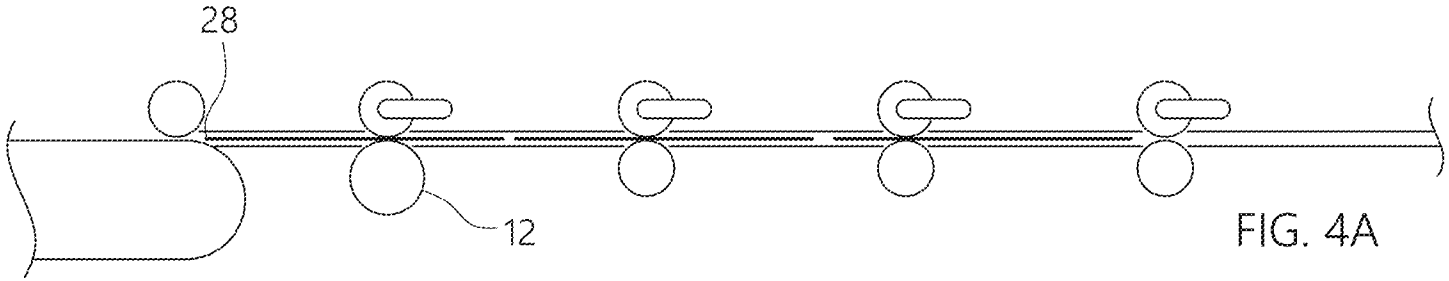
FIG. 4A is a diagrammatic side view of a sheet feeder in a another operating phase.
Figure 4B:
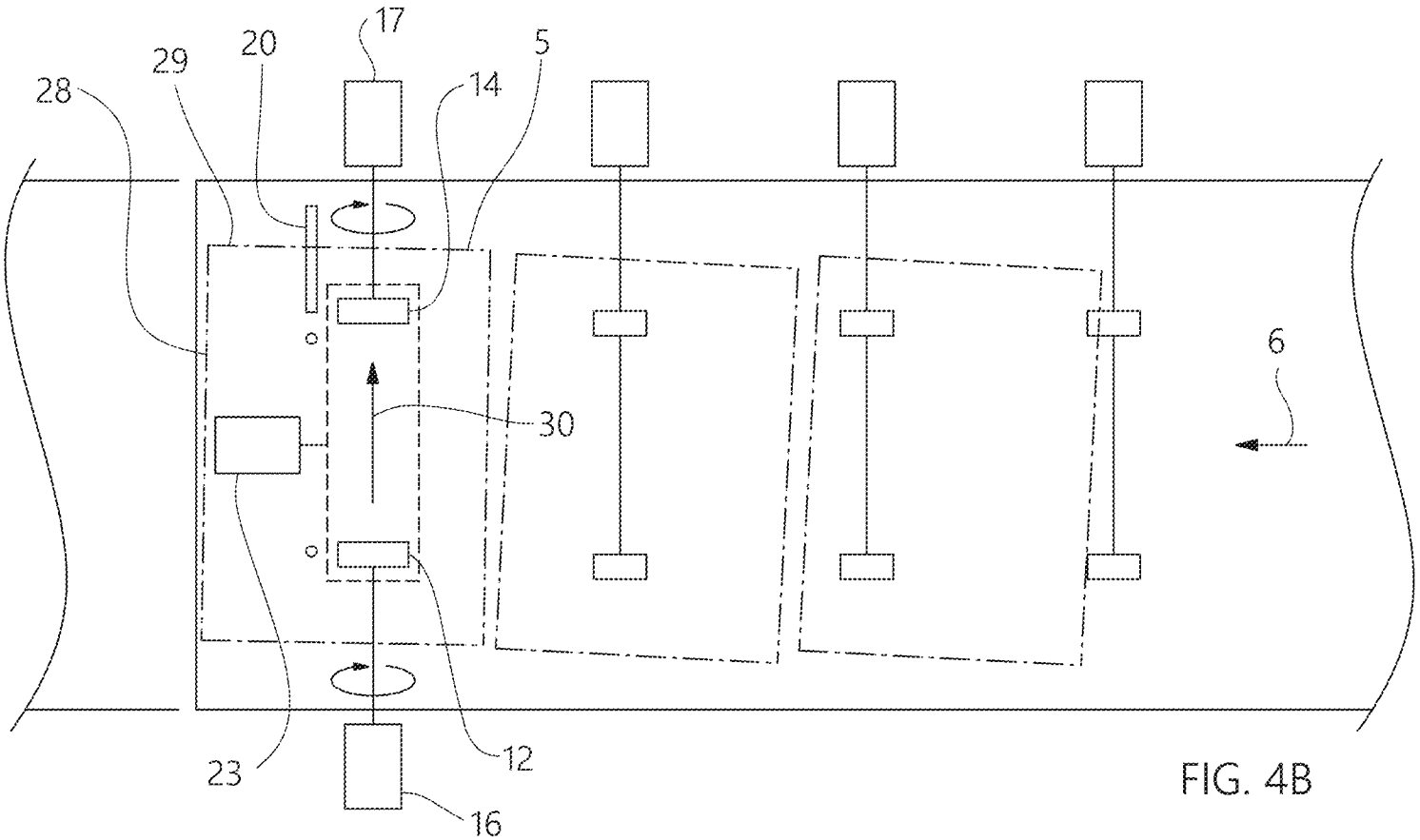
FIG. 4B is a plan view onto the sheet feeder in the operating phase shown in FIG. 4A.

FIGS. 4A and 4B show an operating phase in which the sheet 5 is aligned orthogonally relative to the transport direction 6 and is simultaneously aligned laterally. In order to align the front edge 28 orthogonally relative to the transport direction 6, the second feed roller 14 rotates more quickly than the first feed roller 12. As a consequence, the sheet 5 is rotated about its vertical axis, which is orthogonal to the plane of the drawing in FIG. 4B—this taking place counter-clockwise in the present example. For this purpose, the controller controls the first motor 16 and the second motor 17 with the required speed difference in accordance with the calculated skew angle.

At the same time, the line sensor 20 detects the position of the lateral edge 29 of the sheet 5 and signals the measurement result to the controller. The controller controls the drive 23 in accordance with the signals from the line sensor 20, causing the drive to move the slide 21 in a first direction 30. Together with the slide, the first roller pair 10 and the second roller pair 11 as well as the sheet 5 clamped in the two roller pairs 10, 11 are moved in the first direction 30 until the line sensor 20 signals to the controller that the lateral edge 29 has reached the required setpoint position 31 (cf. FIG. 5B).

Figure 5A:
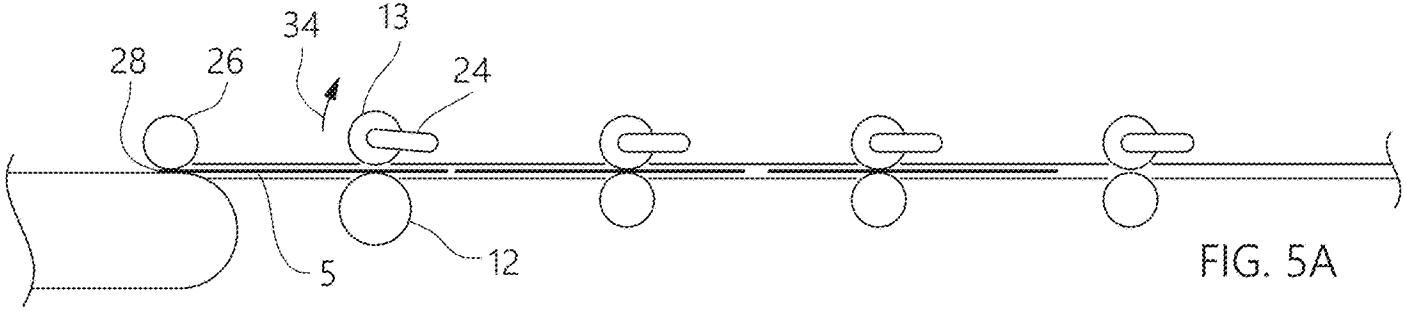
FIG. 5A is a diagrammatic side view of a sheet feeder in another operating phase.
Figure 5B:
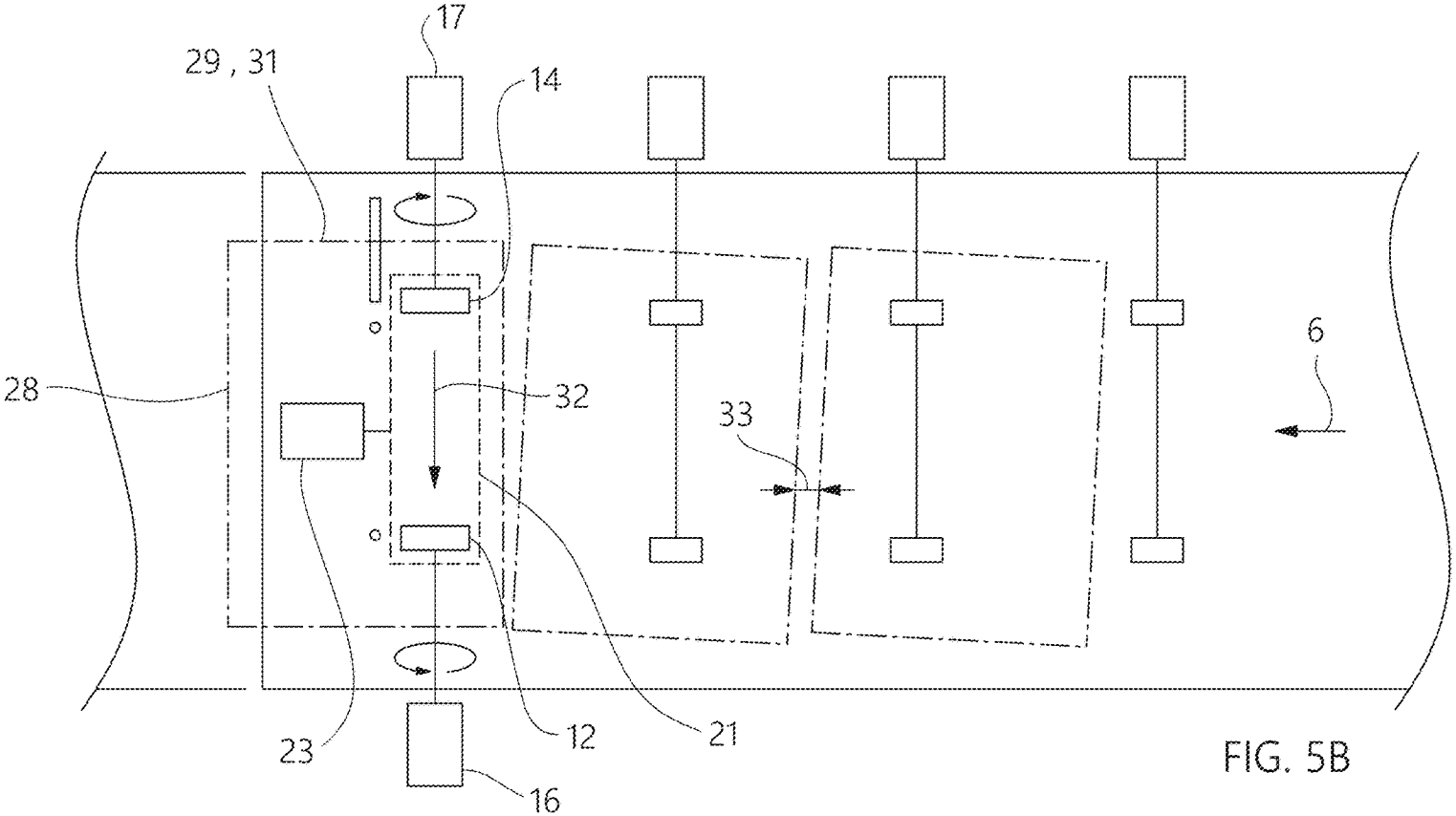
FIG. 5B is a plan view onto the sheet feeder in the operating phase shown in FIG. 5A.

FIGS. 5A and 5B show an operating phase in which the first sheet 5 has reached the alignment thereof required for printing the sheet 5 in the imaging section 4, wherein the front edge 28 is aligned orthogonally to the transport direction 6 and the lateral edge 29 is in the lateral setpoint position 31. At this point in time, the sheet 5 is still between the feed rollers 12, 14 and the counterpressure rollers 13, 15; the rear portion of the sheet 5 is still clamped in the two roller pairs 10, 11. The controller now controls the drive of the support 24 in such a way that the support 24 performs a lift-off motion 34, as a result of which the first counterpressure roller 13 and the second counterpressure roller 15 are raised from the sheet 5. Lifting off the counterpressure rollers 13, 15 releases the clamping of the sheet 5, the sheet is released by the alignment device 1 and in the process is already gripped by the sheet transport device 26. Once the sheet 5 has been clamped at its leading edge between the at least one transport roller of the sheet transport device 26 and the conveyor belt (or alternatively the tray chain), the trailing edge of the sheet 5, although still between the feed rollers 12, 14 and the counterpressure rollers 13, 15, is not subject to clamping. After this, the controller activates the drive 23, with the result that it moves the slide 21 in a second direction 32 back into the neutral position 27.

As can be seen in FIG. 5B, this occurs while the sheet 5 is in "loose" overlap with the feed rollers 12, 14 and the counterpressure rollers 13, 15 of the alignment device 1. By virtue of the fact that the return motion of the slide 21 together with the feed rollers 12, 14 into the central neutral position 27 is already being carried out in a phase in which the trailing portion of the sheet 5 is still opposite the alignment device 1 or the roller pairs 10, 11 thereof, a spacing 33 between the successive sheets 5 can be minimized, thereby advantageously ensuring that a high sheet transport rate is achieved. In the operating situation illustrated in FIGS. 5A and 5B, the first motor 16 and the second motor 17 are already rotating at the same speed again, i.e., they are synchronous with one another.

Figure 6A:
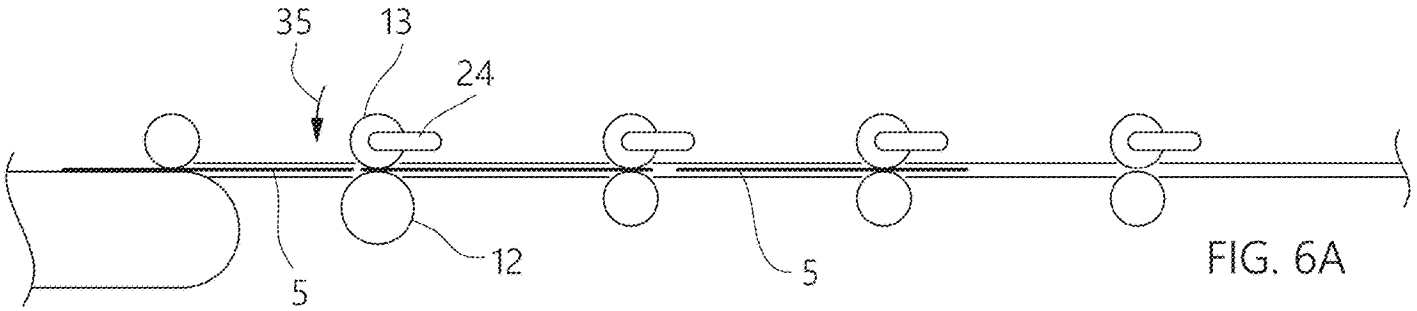
FIG. 6A is a diagrammatic side view of a sheet feeder in yet another operating phase.
Figure 6B:
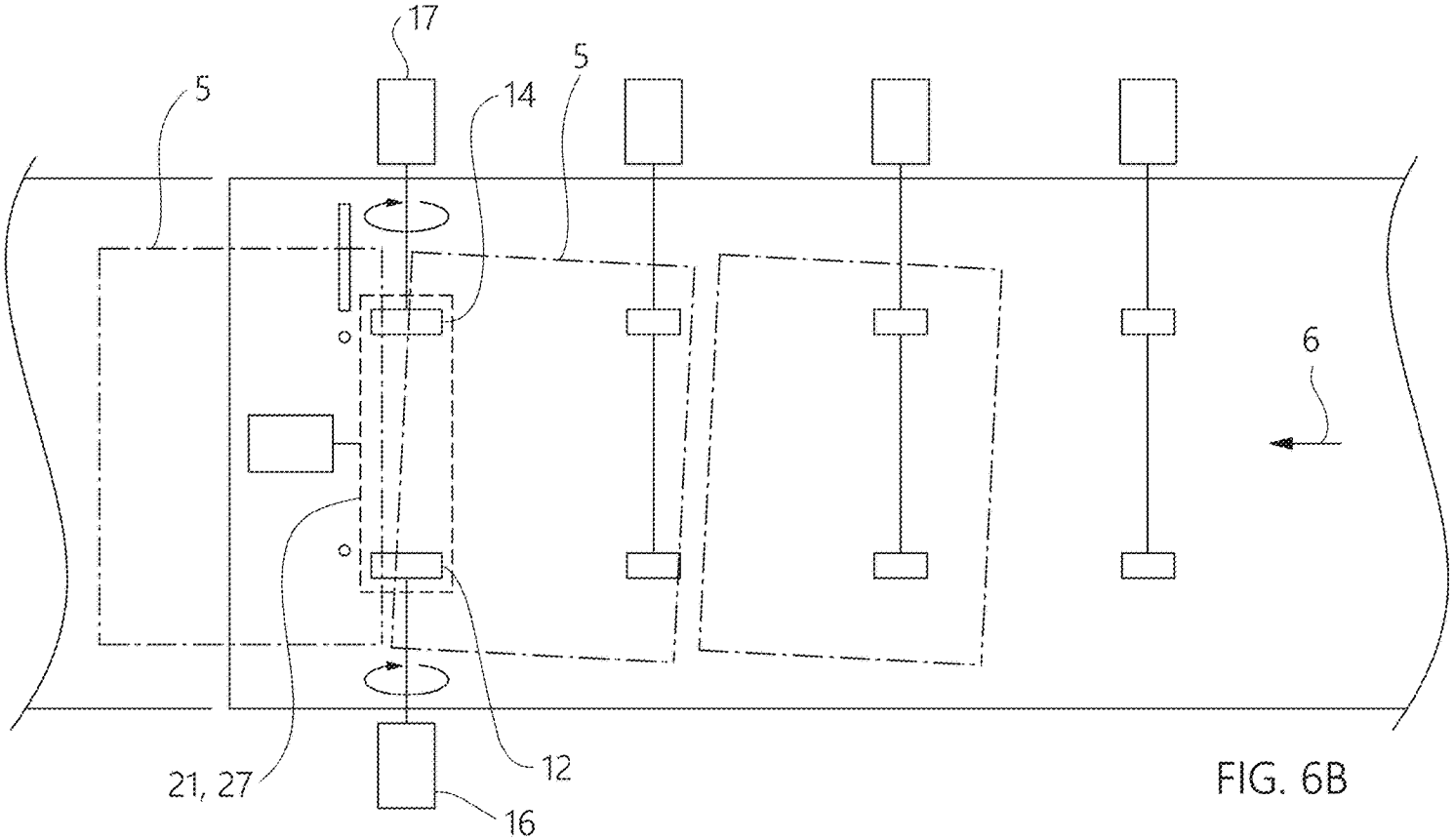
FIG. 6B is a plan view onto the sheet feeder in the operating phase shown in FIG. 6A.

FIGS. 6A and 6B illustrate an operating phase in which the alignment device 1 is ready for the next alignment cycle. The slide 21 is in the central neutral position 27, as are the feed rollers 12, 14 attached to the slide 21. The support 24, together with the counterpressure rollers 13, 15, is also in a central position corresponding to this. The centering device used to return the support 24 to the central position will be explained in greater detail below with reference to FIGS. 7 to 9*c*.

The drive which pivots the support 24 is controlled in such a way that the support 24 performs a set-down motion 35, as a result of which the counterpressure roller 13, 15 is set down onto the feed rollers 12, 14—preferably within the gap between the already aligned sheet 5 and the following sheet 5 which is to be aligned next. This set-down motion 35, together with the lift-off motion 34 in the opposite direction, forms the reciprocating motion 25. By virtue of the fact that the counterpressure rollers 13, 15 are set down on the feed rollers 12, 14 in the gap between the sheets, the next sheet 5 to be aligned is clamped without interference when its leading edge enters the roller pairs 10, 11. The motors 16, 17 and thus the feed rollers 12, 14 rotate at the same speed.

The subsequent alignment of the next sheet 5 takes place in the same way as has already been described by means of the first sheet 5.

Figure 7:
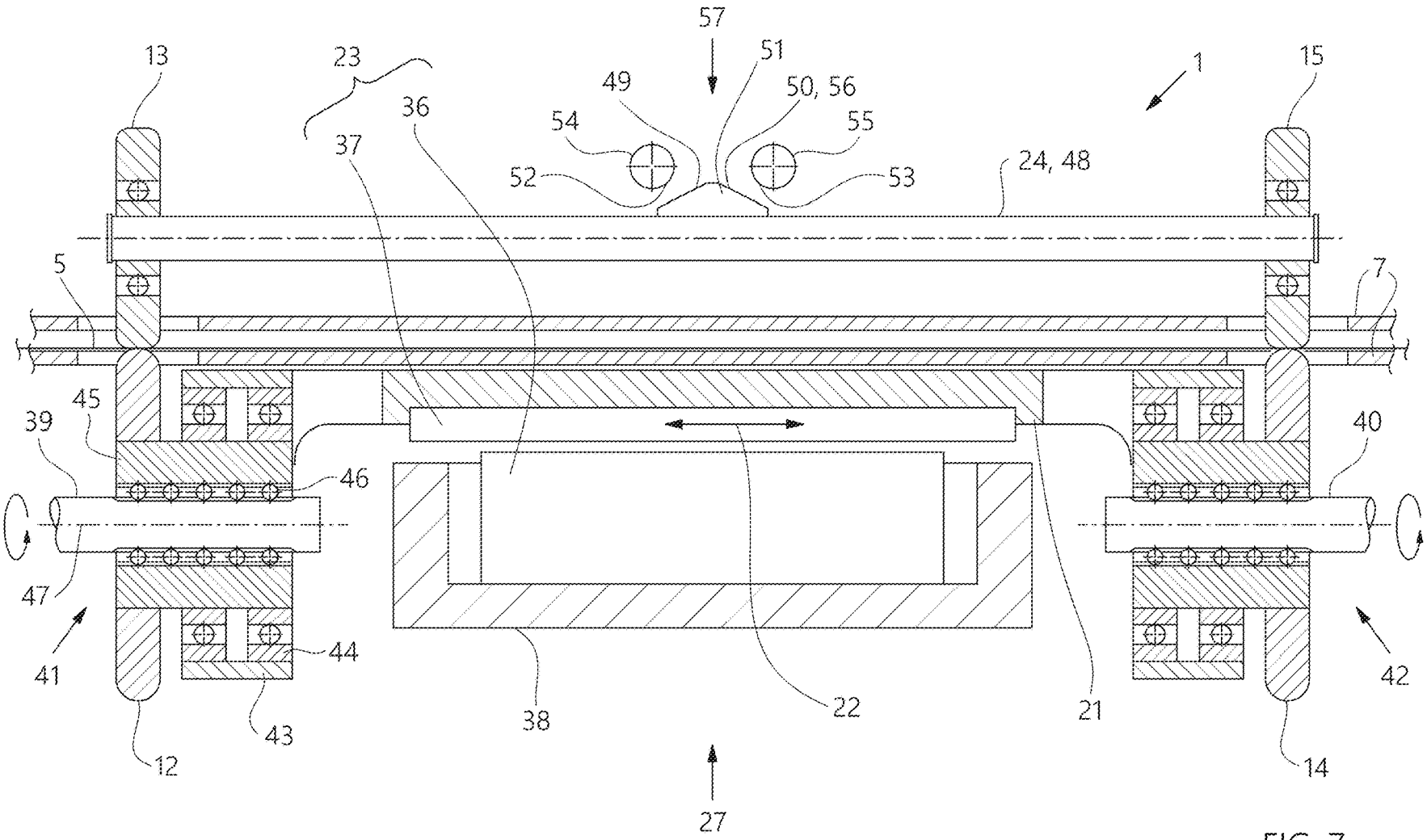
FIG. 7 shows an alignment device of the sheet feeder.

FIG. 7 shows the alignment device 1 in section from a perspective corresponding to the transport direction 6. Here, the drive 23 that drives the adjusting motion 22 for the lateral alignment of the sheet 5 is illustrated in more detail. The drive 23 is a linear motor with a primary part 36 and a secondary part 37. The primary part 36, which may also be referred to as a stator, is arranged on a fixed frame 38 and is designed as a stator with windings. The secondary part 37, which may also be referred to as a rotor, is arranged on the slide 21 and is designed as a permanent magnet in the form of a magnetic plate.

As can be seen in FIG. 1B, the motors 16, 17 of the alignment device 1 are connected to the feed rollers 12, 14 via a shaft 39, 40 in each case.

A first shaft-hub connection 41, by means of which the shaft 39 is connected in a torque-transmitting and axially movable manner to the first feed roller 12, and a second shaft-hub connection 42, via which the shaft 40 is connected in a torque-transmitting and axially movable manner to the second feed roller 14, are illustrated in FIG. 7.

Since the structure of the two shaft-hub connections 41, 42, which are arranged in mirror symmetry, is the same, it is explained below using the example of the first shaft-hub connection 41, which is applicable to both. A bush 45 is rotatably mounted in a downward-projecting side wall 43 of the slide 21 via one or—as shown—a plurality of rolling bearings 44. The shaft 40 is mounted in an axially movable manner in the bush 45 via linear guides 46. Thus, the bush 45, which is mounted in an axially immovable manner in the slide 21, can be moved together with the slide 21 during the adjusting motion 22 thereof relative to the shaft 40 and to the motor 17. Since the feed roller 12 is fixed in an axially movable manner on the bush 45, the linear guides 46 allow a movement of the feed roller 12 in the direction of the geometric axis of rotation 47 relative to the shaft 40 and to the motor 17. In FIG. 7, the linear guides 46 are illustrated in a greatly simplified form, and they are explained in greater detail below with reference to FIGS. 10 and 11.

FIG. 7 furthermore shows that the support 24 comprises an axle 48, on which the counterpressure rollers 13, 15 are rotatably seated. For reasons of graphical simplification, the fact that the counterpressure rollers 13, 15 are secured against axial displacement on the axle 48 is not illustrated. Arranged on the support 24 are a first centering surface 49 and a second centering surface 5, which are formed on a wedge 51 attached to the axle 48. The wedge 51 is arranged between a third centering surface 52 and a fourth centering surface 53, which are formed on small rollers 54, 55. The small rollers 54, 55 are mounted rotatably and in a fixed location separately from the support 24, e.g. on a machine frame. Instead of the small rollers 54, 55, it would also be possible to provide non-rotatable pins, although higher wear on the centering surfaces 49, 50, 52, 53 than when using the small rollers 54, 55 would be to be expected. The center lines of the small rollers 54, 55 are oriented parallel to one another and orthogonal relative to the axle 48. The centering surfaces 49, 50, 52, 53 together form a centering device 56 for centering the support 24 with the counterpressure rollers 13, 15 in the central position 57, which is in alignment with the central neutral position 27 of the slide 21 with the feed rollers 12, 14, as illustrated in FIG. 7.

Figure 8:
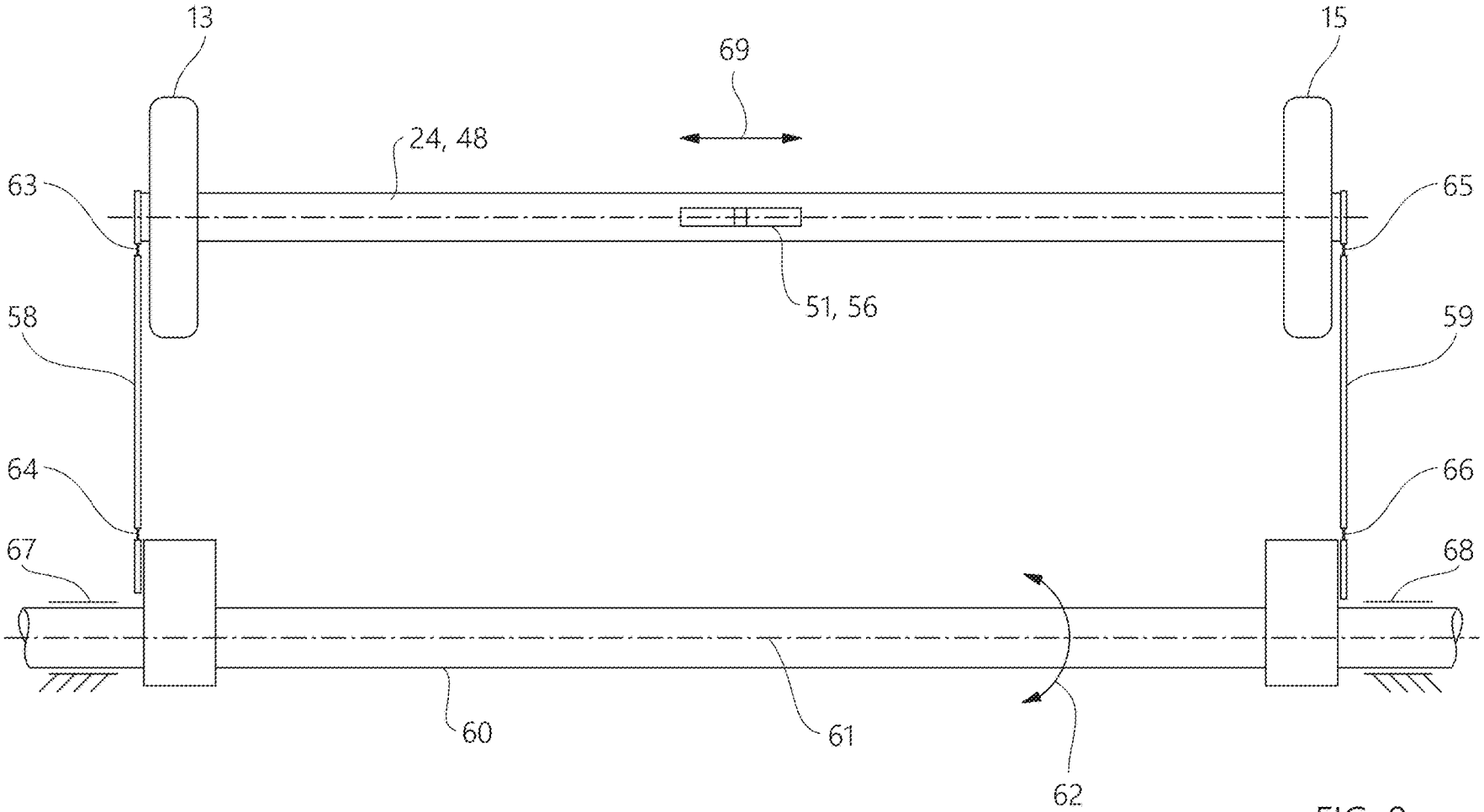
FIG. 8 shows a support with counterpressure rollers of the alignment device.

In FIG. 8, the support 24 is illustrated as a detail, together with its mounting, which is not included in FIG. 7. The axle 48 is connected to a shaft 60 at its one end via a first arm 58 and at its other end via a second arm 59. Via the first arm 58 and the second arm 59, the reciprocating motion 25 (FIG. 1A) is transferred from the shaft 60 to the axle 48, which is pivoted about the axis of rotation 61 of the shaft 60 during this process. The shaft 60 is rotatably mounted in the machine frame by means of rotary bearings 67, 68, which are indicated symbolically in the drawing, and is driven in such a way that it performs a rotary backward and forward motion 62 about the axis of rotation 61 at the delivery rate of the sheets 5.

The first arm 58 has a first joint 63 and a second joint 64, and the second arm 59 has a third joint 65 and a fourth joint 66. The joints 63, 64, 65, 66 are solid-body joints 63, 64, 65, 66 and enable a transverse motion 69 of the support 24 with the counterpressure rollers 13, 15. To form the solid-body joints 63, 64, 65, 66, the two arms 58, 59 are weakened in a defined manner at these locations. During the lateral alignment of the sheet 5, the transverse motion 69 takes place asynchronously and in parallel with the adjusting motion 22 (FIG. 1B). The rotary bearings 67, 68 enable vertical adjustment of the support 24, namely the vertical component of the pivoting motion which the support 24 performs around the rotary bearings 67, 68. The solid-body joints 63, 64, 65, 66 enable a horizontal adjustment of the support 24, namely, the transverse motion 69, wherein the arms 58, 59 are deformed elastically in the solid-body joints 63, 64, 65, 66.

Figure 9A:
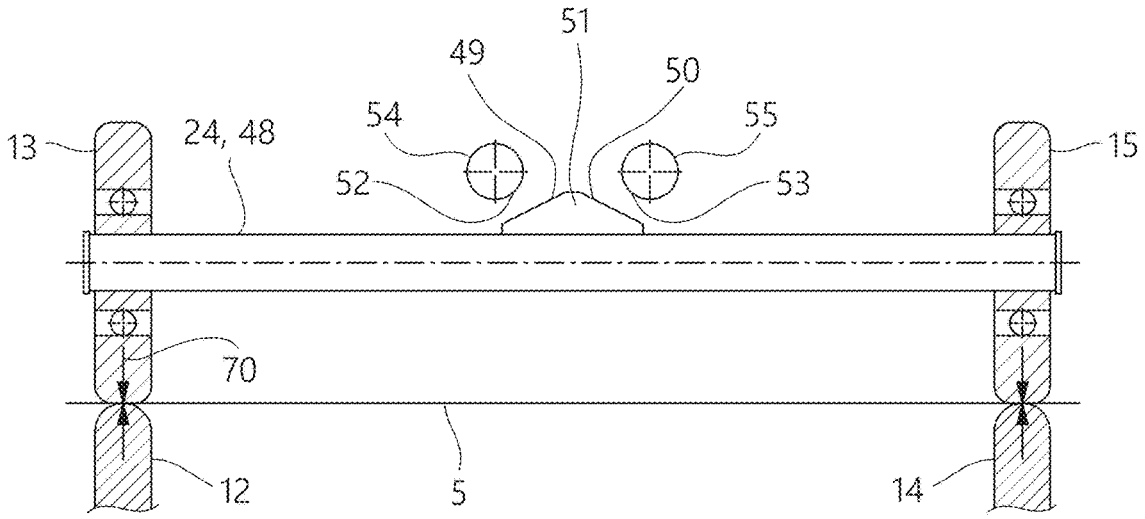
FIGS. 9A, 9B, and 9C show the support in various operating phrases.
Figure 9B:
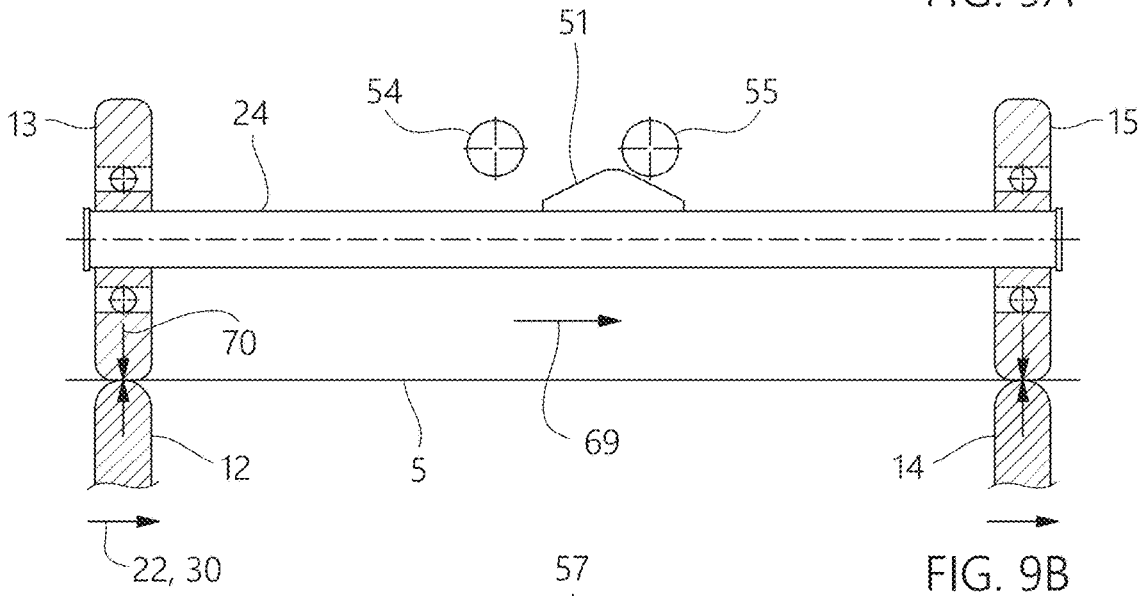
Figure 9C:
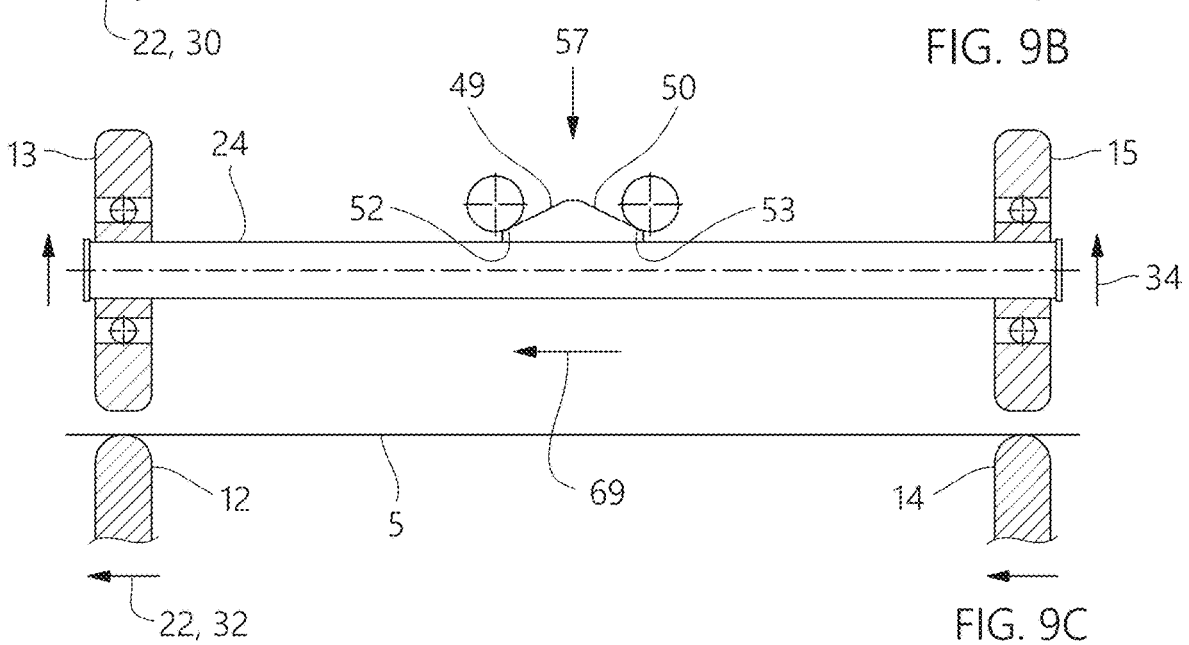

FIGS. 9A to 9C show the successive phases during the alignment of the support 24 by means of the centering device 56.

FIG. 9A shows a first phase, in which the slide 21 with the feed rollers 12, 14 is in the central, neutral position 27, and the support 24 with the counterpressure rollers 13, 15 is in the central position 57, with the result that the first feed roller 12 and the first counterpressure roller 13 are situated on one line, and the second feed roller 14 and the second counterpressure roller 15 are likewise situated on one line. The counterpressure rollers 13, 15 are pressed against the feed rollers 12, 14, and the sheet 5 is thereby clamped between the rotating feed rollers 12, 14 and the rotating counterpressure rollers 13, 15. The clamping forces 70 of the rollers 12, 13, 14, 15 are indicated symbolically by arrows in the drawing. In the first phase described here, the wedge 51 is situated precisely in the center between the small rollers 54, 55 but without contact between the first centering surface 49 and the third centering surface 52 and without contact between the second centering surface 50 and the fourth centering surface 53.

FIG. 9B shows a second phase of the alignment process, in which the slide 21 with the feed rollers 12, 14 moves to the right when viewed in the transport direction 6. The adjusting motion 22 required for this purpose in the first direction 30 is driven by the linear motor (drive 23). During this process, the sheet 5 is moved on account of the friction between the feed rollers 12, 14 and the sheet 5, and the support 24 together with the counterpressure rollers 13, 15 is moved on account of the friction between the sheet 5 and the counterpressure rollers 13, 15. As a result, the support 24 performs the transverse motion 69 to the right. Although the position of the wedge 51 relative to the small rollers 54, 55 changes during this process, this happens without the wedge 51 coming into contact with the small rollers 54, 55. The transverse motion 69 continues until the controller controlling the drive 23 of the slide 21 receives signals from the line sensor 20 (FIG. 1B) indicating that the lateral edge 29 of the sheet 5 has reached its setpoint position 31 (FIG. 5B). The centering surfaces 50, 53 are arranged in such a way that contact between them is excluded even in the case of a maximum transverse motion 69.

FIG. 9C shows a third phase, in which the slide 21 and the support 24 move back again after the lateral alignment of the sheet 5 has taken place. During this process, the support 24 is moved upward with the lift-off motion 34, wherein the counterpressure rollers 13, 15 lift off from the sheet 5. On account of the lift-off motion 34, the second centering surface 50 comes into contact with the fourth centering surface 53, with the result that the support 24 is pushed back toward the left into its central position 57 by means of this thrusting wedge effect, wherein the support 24 with the counterpressure rollers 13, 15 performs the transverse motion 69 to the left. When the support 24 has reached the central position 57, the first centering surface 49 rests against the third centering surface 52, and the second centering surface 50 rests against the fourth centering surface 53; the support 24 is thus centered.

In the third phase, the drive 23 of the slide 21 drives the adjusting motion 22 of the slide 21 in the second direction 32 until the slide 21 has reached the central neutral position 27. This takes place at least partially in a period of time in which the sheet 5 is still between the rotating feed rollers 12, 14, on which it rests loosely without a clamping force 70, and the raised counterpressure rollers 13, 15.

After this, the cycle is complete, and the next cycle for the lateral alignment of the next sheet 5 begins with the lowering of the support 24. During this process, the support 24 carries out the set-down motion 35 (FIG. 6A), and the next sheet 5 is clamped between the feed rollers 12, 14 and the counterpressure rollers 13, 15. By means of the set-down motion 35, the support 24 moves out of its position according to FIG. 9C into its position according to FIG. 9A.

Figure 10:
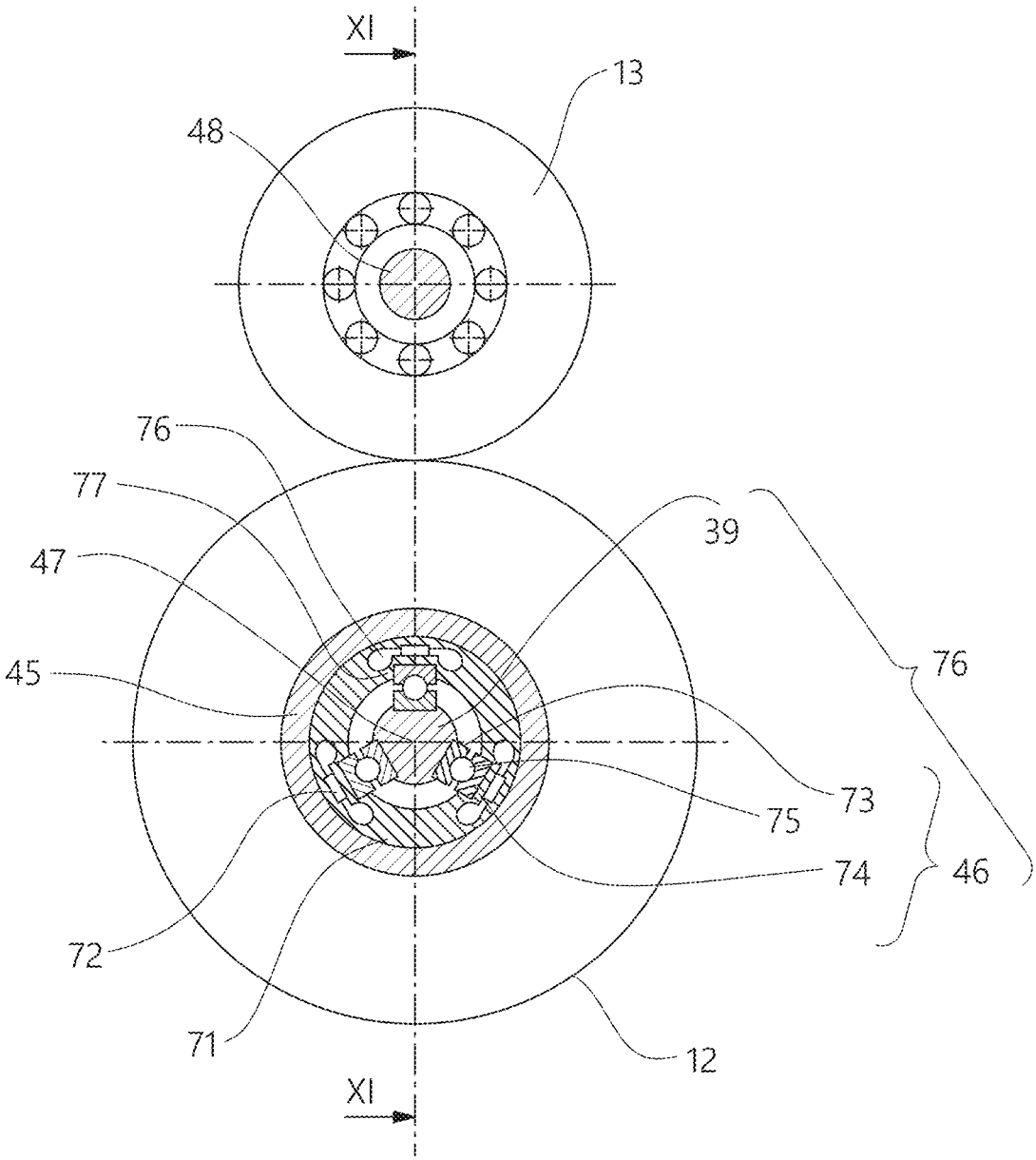
FIG. 10 is a side view of a drive connection of the alignment device.
Figure 11:
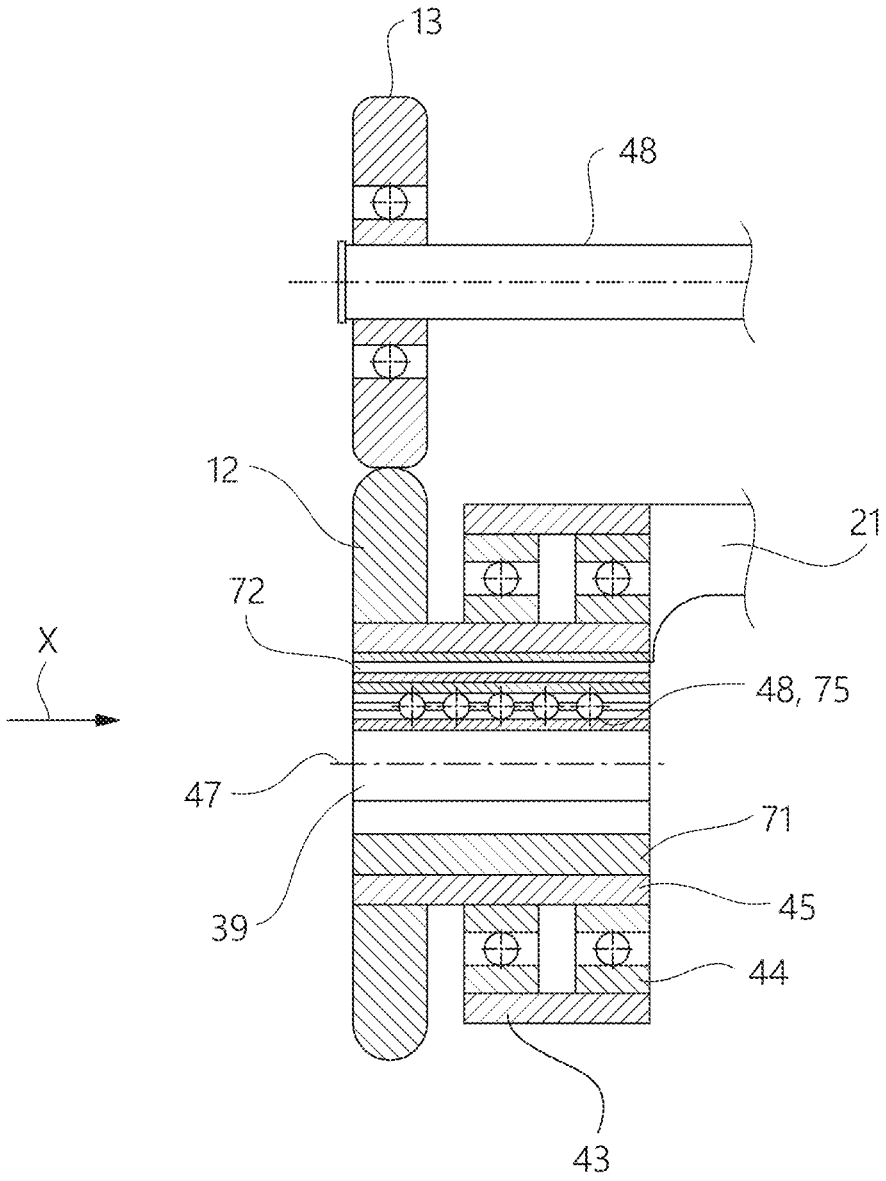
FIG. 11 is a front view of the drive connection.

In FIGS. 10 and 11, the shaft-hub connection 41, which was illustrated in a greatly simplified form in FIG. 7, is illustrated in detail. FIG. 10 is a view in the direction of view X indicated in FIG. 11, and FIG. 11 is a view according to the section line XI-XI indicated in FIG. 10. It is apparent that there is a spring collet 71 seated in the bush 45. The spring collet 71 is referred to as such because springs 72 for clamping the linear guides 46 are arranged therein. The linear guides 46 are arranged in a uniformly distributed manner around the axis of rotation 47. In the example shown with three linear guides 46, there is therefore one of the linear guides 46 arranged every 120°.

Each linear guide 46 comprises a running rail 73 which is situated on the inside with respect to the axis of rotation 47, that is to say radially, a running rail 74 situated on the outside, and rolling elements 75, which are arranged therebetween and run on the running rails 73, 74 during the adjustment of the slide 21. A cage, which holds the rolling elements 75 at a predetermined spacing with respect to one another, is not illustrated specifically in the drawing. The rolling elements 75 are designed as balls, and the linear guides 46 can be referred to specifically as ball cage rail guides.

The springs 72 are each arranged in a cavity 76 of the spring collet 71 and are each supported on the radially inner wall and the radially outer wall of the cavity 76 while being subject to a preload. The outer running rails 74 are let into the inner walls of the cavity 76, and the inner running rails 73 are let into the shaft 39. Owing to the pressure of the springs 72 on the inner walls, solid-body joints 77, which the inner walls support in respective pairs, are deformed elastically. As a result, the inner walls of the cavities 76 are deflected radially inward and the inside diameter of the spring collet 71 is elastically reduced. As a consequence, the assemblies, each consisting of an outer running rail 74, the rolling elements 75, and an inner running rail 73, are compressed and preloaded.

In the present case, strip-shaped or band-shaped wave springs are employed as the springs 72. In contrast to typical wave springs, these are not annular but rectilinear. The springs 72 consist of spring steel sheet. As the springs 72 are subjected to a load, the "amplitude" of the waves of the springs 71 is reduced.

The shaft 39 and the linear guides 46 inserted into the shaft 39 together form a torque-transmitting splined shaft 76, wherein the linear guides 46 form the splines of the splined shaft 76. The torque transmitted from the first motor 16 to the linear guides 46 via the shaft 39 is transmitted by the linear guides 46 to the spring collet 71 and thus to the bush 45, which is fixed on the spring collet 71 and via which the rolling bearing or bearings 44 is/are rotatably mounted in the slide 21. The spring collet 71 can be referred to as the first bush 71, and bush 45 can be referred to as the second bush 45.

The following is a summary list of reference numerals and the corresponding structure used in the above description of the invention:

1 alignment device
2 feeder
3 machine
4 imaging section
5 sheet
6 transport direction
7 guide plate
8 transport gap
9 transport device
10 first roller pair
11 second roller pair
12 first feed roller
13 first counterpressure roller
14 second feed roller
15 second counterpressure roller
16 first motor
17 second motor
18 sheet transport plane
19 sensor
20 line sensor
21 slide
22 adjusting motion
23 drive
24 support
25 reciprocating motion
26 sheet transport direction
27 neutral position
28 leading edge
29 lateral edge
30 first direction
31 setpoint position
32 second direction
33 spacing
34 lift-off motion
35 set-down motion
36 primary part
37 secondary part
38 frame
39 shaft
40 shaft
41 first shaft-hub connection
42 second shaft-hub connection
43 side wall
44 rolling bearing
45 second bush
46 linear guide
47 axis of rotation
48 axle
49 first centering surface
50 second centering surface
51 wedge
52 third centering surface
53 fourth centering surface
54 small roller
55 small roller
56 centering device
57 central position
58 first arm
59 second arm
60 shaft
61 axis of rotation
62 backward and forward motion
63 first solid-body joint
64 second solid-body joint
65 third solid-body joint
66 fourth solid-body joint
67 rotary bearing
68 rotary bearing
69 transverse motion
70 clamping force
71 spring collet (first bush)
72 spring
73 inner running rail
74 outer running rail

75 rolling element
76 cavity
77 solid-body joint

The invention claimed is:

1. A method for aligning a sheet in a feeder of a sheet-processing machine, the method comprising:

transporting a plurality of sheets in a transport direction with one sheet following another in a sheet transport cycle;

delivering the sheet to be aligned to a sheet transport device in the transport direction by a first feed roller and a first counterpressure roller cooperating with the first feed roller, and by a second feed roller and a second counterpressure roller cooperating with the second feed roller, wherein the first and second feed rollers are commonly mounted on a slide that is movable, with the first and second feed rollers, in a direction transversely to the transport direction;

driving the first feed roller in rotation by a first motor and simultaneously driving the second feed roller in rotation by a second motor;

performing a set-down motion, wherein the first and second counterpressure rollers are set down onto the first and second feed rollers, respectively, and a lift-off motion by pivoting a support upon which the first and second counterpressure rollers are rotatably mounted, and performing the set-down motion and the lift-off motion in synchronicity with the sheet transport cycle;

in a first alignment step, aligning the sheet laterally by clamping the sheet between the first feed roller and the first counterpressure roller and between the second feed roller and the second counterpressure roller, and moving the slide on which the first feed roller and the second feed roller are mounted together with the clamped sheet in a first direction transversely to the transport direction;

in a second alignment step, after the sheet has been gripped by the sheet transport device, lifting the first counterpressure roller from the sheet on the first feed roller, and lifting the second counterpressure roller from the sheet on the second feed roller; and in a third alignment step, subsequent to lifting the first and second counterpressure rollers from the sheet, moving the slide with the first feed roller and the second feed roller back in a second direction counter to the first direction while the sheet, which is no longer clamped between the first and second feed rollers and the respective first and second counterpressure rollers, is still present in a region between the first feed roller and the first counterpressure roller and in a region between the second feed roller and the second counterpressure roller;

during a movement of the slide in the first direction and in the second direction, moving the slide relative to the first motor and relative to the second motor.

2. The method according to claim 1, which comprises performing a skew correction on the sheet by driving the first feed roller by the first motor at a different speed from driving the second feed roller by the second motor.

3. The method according to claim 1, which comprises driving the slide in the first direction and in the second direction by an electromagnetic linear motor drive.

* * * * *